US007360859B2

(12) United States Patent
Little et al.

(10) Patent No.: US 7,360,859 B2
(45) Date of Patent: Apr. 22, 2008

(54) UNCLOGGING PRINTER NOZZLES

(75) Inventors: Robert F. Little, Escondido, CA (US); Cesar Fernandez Espasa, San Diego, CA (US); Santiago Garcia-Reyero Vinas, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 365 days.

(21) Appl. No.: 11/041,326

(22) Filed: Jan. 24, 2005

(65) Prior Publication Data

US 2006/0164457 A1 Jul. 27, 2006

(51) Int. Cl.
*B41J 29/393* (2006.01)

(52) U.S. Cl. ..... 347/19; 347/23; 347/30

(58) Field of Classification Search ..... 347/23, 347/19, 12, 14, 30
See application file for complete search history.

(56) References Cited

U.S. PATENT DOCUMENTS 5,659,342 A 8/1997 Lund et al.
5,850,236 A * 12/1998 Murai et al. ..... 347/23
6,293,646 B1 9/2001 Beachnau
6,575,545 B2 6/2003 Vega et al.

FOREIGN PATENT DOCUMENTS

| | | |
|---|---|---|
| EP | 799701 | 10/1997 |
| EP | 1151868 | 11/2001 |
| WO | 11192729 | 7/1999 |

OTHER PUBLICATIONS

European Search Report for EP Patent App. No. 06 10 0645 , dated Aug. 9, 2006.

* cited by examiner

*Primary Examiner*—Lam S Nguyen

(57) ABSTRACT

In one embodiment, a method for printing includes selecting a nozzle for printing a pixel, determining a time since the nozzle was last actuated, and, if the time since the nozzle was last actuated exceeds a threshold time, then, before actuating the nozzle to print the pixel, actuating the nozzle a number of actuations corresponding to the time since the nozzle was last actuated.

2 Claims, 4 Drawing Sheets

UNCLOGGING PRINTER NOZZLES

BACKGROUND

Inkjet printers eject drops of ink through very small openings, sometimes called nozzles, on to a print medium. Each drop forms a dot, sometimes called a pixel, on the media. Printed images are formed from many such pixels. Ink ejection nozzles that are not used frequently may become clogged as liquid evaporates from ink in the nozzles or from ink lying on the upstream side of the nozzles. Ink drops cannot be ejected through clogged nozzles. Hence, it is desirable to unclog a nozzle before using the nozzle to print a pixel.

DRAWINGS

DESCRIPTION

The exemplary embodiments shown in the figures and described below illustrate but do not limit the invention. Other forms, details, and embodiments may be made and implemented. Hence, the following description should not be construed to limit the scope of the invention, which is defined in the claims that follow the description.

Figure 1:
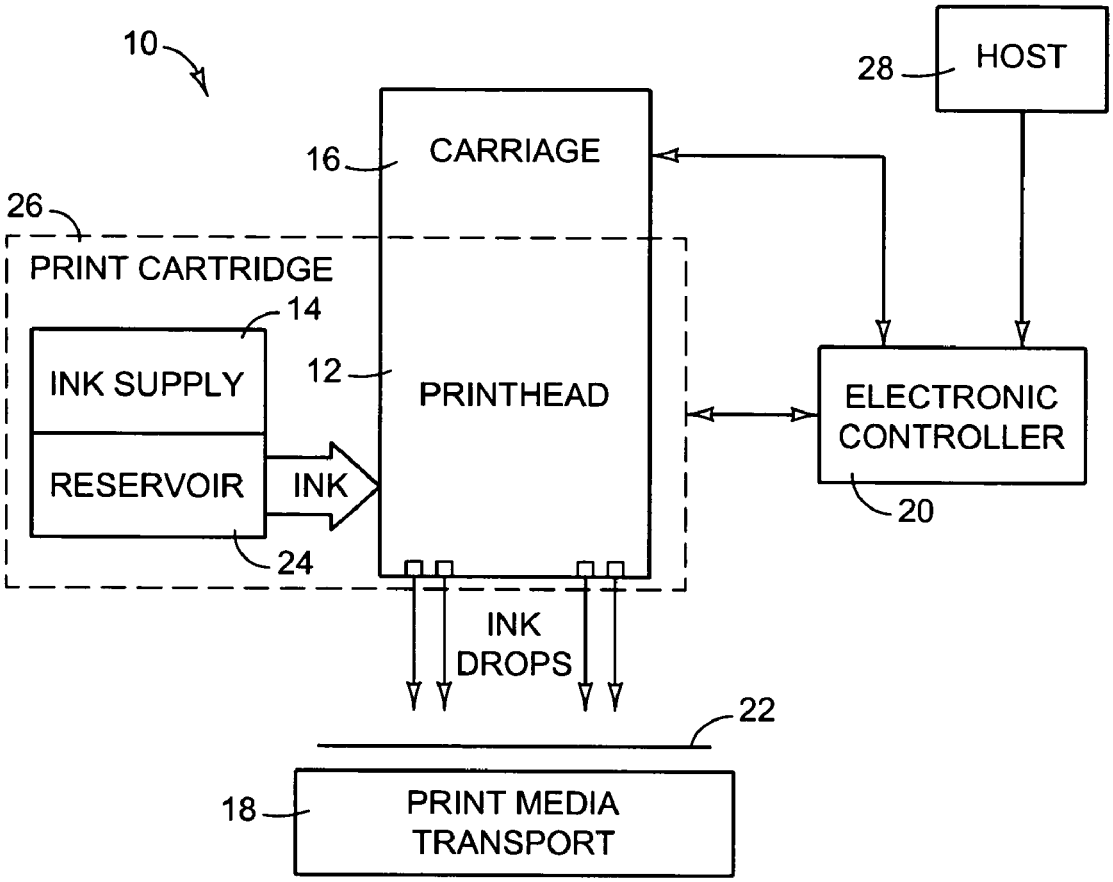
FIG. 1 is a block diagram illustrating an inkjet printer that may be used to implement embodiments of the invention.

FIG. 1 is a block diagram illustrating an inkjet printer that may be used to implement embodiments of the invention. Referring to FIG. 1, inkjet printer 10 includes a printhead 12, an ink supply 14, a carriage 16, a print media transport mechanism 18 and an electronic printer controller 20. Printhead 12 represents generally one or more printheads and the associated mechanical and electrical components for ejecting drops of ink on to a sheet or strip of print media 22. A typical thermal inkjet printhead includes a nozzle plate arrayed with ink ejection nozzles and firing resistors formed on an integrated circuit chip positioned behind the ink ejection nozzles. The ink ejection nozzles are usually arrayed in columns along the nozzle plate. A flexible circuit carries electrical traces from external contact pads to the firing resistors. Each print head is electrically connected to printer controller 20 through the contact pads. In operation, printer controller 20 selectively energizes the firing resistors through the signal traces. When a firing resistor is energized, a vapor bubble forms in the ink chamber, ejecting a drop of ink through a nozzle on to the print media 22. The vapor bubble collapses, and the ink chamber then refills with ink from an ink reservoir 24 connected to ink supply 14 in preparation for the next ejection. In a piezoelectric printhead, piezoelectric elements are used to eject ink from a nozzle instead of firing resistors. Piezoelectric elements located close to the nozzles are caused to deform very rapidly to eject ink through the nozzles.

Printhead 12 may include a series of stationary printheads that span the width of print media 22. Alternatively, printhead 12 may include a single printhead that scans back and forth on carriage 16 across the width of media 22. Other printhead configurations are possible. For example, for bar codes and other images printed on a comparatively narrow media strip 22, such as might be the case for printing bar code and other labels, printhead 12 may include a single stationary printhead. Carriage 16 positions printhead 12 relative to media 22 and media transport 18 positions media 22 relative to printhead 12. For a scanning type printhead 12, carriage 16 is a movable carriage that includes a drive mechanism to carry printhead 12 back and forth across media 22. A movable carriage 16, for example, may include a holder for printhead 12, a guide along which the holder moves, a drive motor, and a belt and pulley system that moves the holder along the guide. Media transport 18 advances print media 22 lengthwise past printhead 12. For a stationary printhead 12, media transport 18 may advance media 22 continuously past printhead 12. For a scanning printhead 12, media transport 18 may advance media 22 incrementally past printhead 12, stopping as each swath is printed and then advancing media 22 for printing the next swath.

Ink supply 14 supplies ink to printhead 12 through ink reservoir 24. Ink supply 14, reservoir 24 and printhead 12 may be housed together in a single print cartridge 26, as indicated by the dashed line in FIG. 1. Alternatively, ink supply 14 may be housed separate from ink reservoir 24 and printhead 12, in which case ink is supplied to reservoir 24 and printhead 12 through a flexible tube or other suitable conduit. In other embodiments, ink may be supplied directly from ink supply 14 to printhead 12 without an intervening reservoir 24.

Controller 20 receives print data from a computer or other host device 28 and processes that data into printer control information and image data. Controller 20 controls the movement of carriage 16 and media transport 18. As noted above, controller 20 is electrically connected to printhead 12 to energize the firing resistors to eject ink drops on to media 22. By coordinating the relative position of printhead 12 and media 22 with the ejection of ink drops, controller 20 produces the desired image on media 22 according to the print data received from host device 28.

Figure 2:
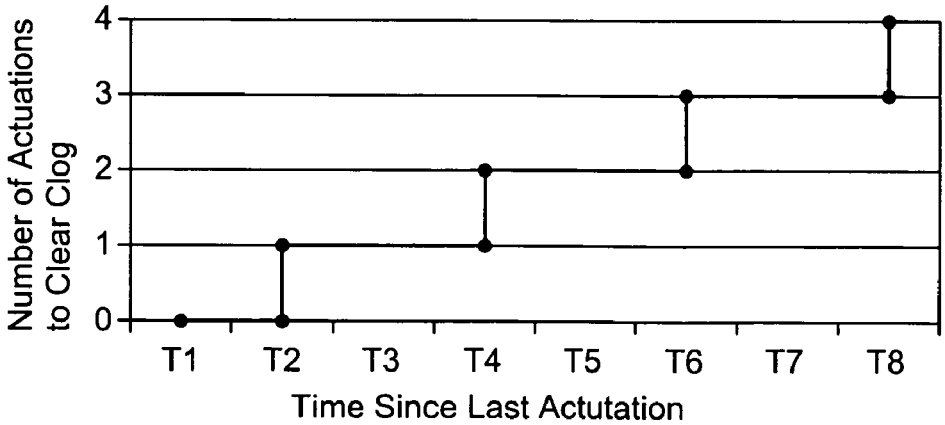
FIG. 2 is a graph illustrating a relationship between the time since a nozzle was last actuated and the number of times the nozzle is actuated to unclog the nozzle.

Ink evaporates when exposed to air, causing ink in a nozzle to become more viscous. After enough ink has evaporated, the viscous ink forms a plug and the nozzle becomes clogged. FIG. 2 is a graph illustrating one exemplary relationship between the time since a nozzle was last actuated and the number of times the nozzle should be actuated to unclog the nozzle. As used in this document, actuating a nozzle means energizing a firing resistor or piezoelectric element associated with the nozzle or otherwise attempting to eject ink or another liquid marking material through the nozzle. The time since the nozzle was last actuated falls along the horizontal axis in FIG. 2 and the number of times the nozzle should be actuated to unclog the nozzle falls along the vertical axis.

Referring to FIG. 2, up to time T2 the nozzle is not expected to be clogged and, therefore, the nozzle need not be actuated more than the actuation required to print the desired pixel. That is to say, no clearing actuations are needed. At time T2, it is expected that a viscous plug will begin to form and clog the nozzle. The clog will grow more severe until time T8 when the viscous plug is fully hardened. Between time T2 and T4, the nozzle is actuated one time to clear the clog before the nozzle is actuated to print the desired pixel. Between time T4 and T6, the nozzle is actuated two times to clear the clog before the nozzle is actuated to print the desired pixel. Between time T6 and T8, the nozzle is actuated three times to clear the clog before the nozzle is actuated to print the desire pixel. After time T8, the nozzle is actuated four times to clear the clog before the nozzle is actuated to print the desired pixel. The nozzle clearing actuations work to eject the nozzle clogging viscous plug from the nozzle, so that ink can be dispensed through the nozzle.

The time it takes for a nozzle to clog and the relationship between the time since a nozzle was last actuated and the number of times the nozzle is actuated to unclog the nozzle may vary according to several factors, including the characteristics of the ink or other marking material, the characteristics of the nozzles and other elements in the printhead, the total number of times that the nozzle has been actuated in its life, and the printer operating conditions and environment. While it is expected that this relationship will often be established empirically, any suitable technique may be used, including modeling. The relationship may be varied during or between printing operations, at discrete intervals or continuously in real time, to maintain the desired print quality.

In one industrial inkjet printing application, for example, in which a full media width stationary printhead is used for high volume printing, an uncapped nozzle that is not fired for about ⅓ second will clog. In this example, therefore, time T2 in FIG. 2 is ⅓ second. From time T2 to a time T4 of about 3 seconds, a single actuation is used to clear the clog. From time T4 to a time T6 of about 5 seconds, two actuations are used to clear the clog. From T6 to a time T8 of about 15 seconds, three actuations are used to clear the clog. After a time T8 of about 15 seconds, four actuations are used to clear the clog.

Figure 3:
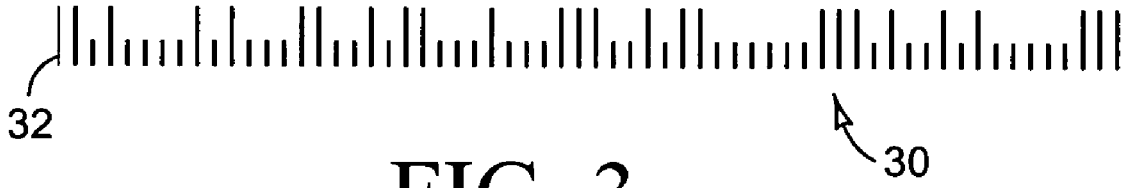
FIG. 3 illustrates a bar code printed with a column of clogged nozzles.
Figure 4:
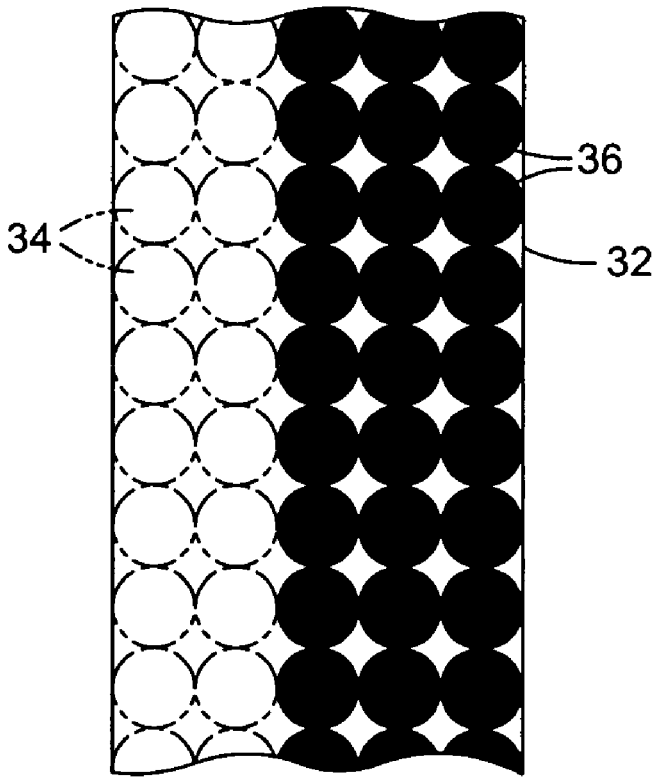
FIG. 4 is a detail view of the first bar of the bar code shown in FIG. 3.

FIG. 3 illustrates a bar code 30 printed with a column of clogged nozzles. FIG. 4 is a detail view of the first bar 32 of bar code 30. Referring to FIGS. 3 and 4, the clogged nozzles make the first bar 32 in bar code 30 too narrow because the first two nozzle actuations unclog the nozzles rather than print pixels. The empty white phantom line dots 34 in FIG. 4 depict the desired location of printed pixels but where no fluid or only watery fluid is ejected due to clogged nozzles. The solid black dots 36 depict pixels printed across only part of the desired width of bar 32. As noted above, the number of nozzle actuations needed to clear a clogged nozzle will vary depending on the time since the nozzle was last fired. FIG. 4 illustrates two nozzle actuations to clear the clog followed by a printed pixel.

Figure 5:
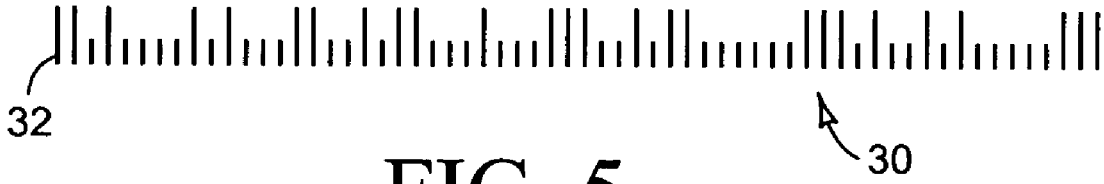
FIG. 5 illustrates a bar code printed with a column of clogged nozzles that are unclogged before printing the first pixel in the first bar in the bar code.
Figure 6:
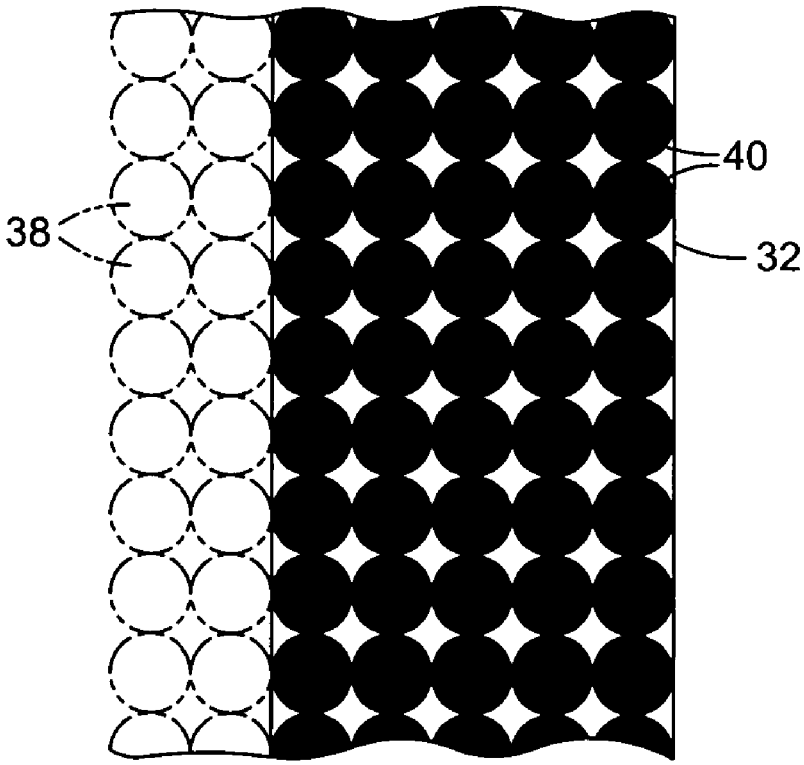
FIG. 6 is a detail view of the first bar of the bar code shown in FIG. 5.

FIGS. 5 and 6 illustrate bar code 30 printed with a column of clogged nozzles that are unclogged before printing the first pixel at the desired location in first bar 32. Referring to FIGS. 5 and 6, first bar 32 in bar code 30 is the desired width because the two nozzle actuations needed to clear the clogged nozzles occur before the nozzle actuation that prints the pixel in bar 32. The empty white phantom line dots 38 in FIG. 6 depict the unclogging nozzle actuations where no fluid is ejected. The solid black dots 40 depict the pixels printed across the full width of bar 32. In the embodiment shown in FIG. 6, the clogged nozzles are actuated twice immediately before actuating the nozzles to print the first pixel in bar 32.

Figure 7:
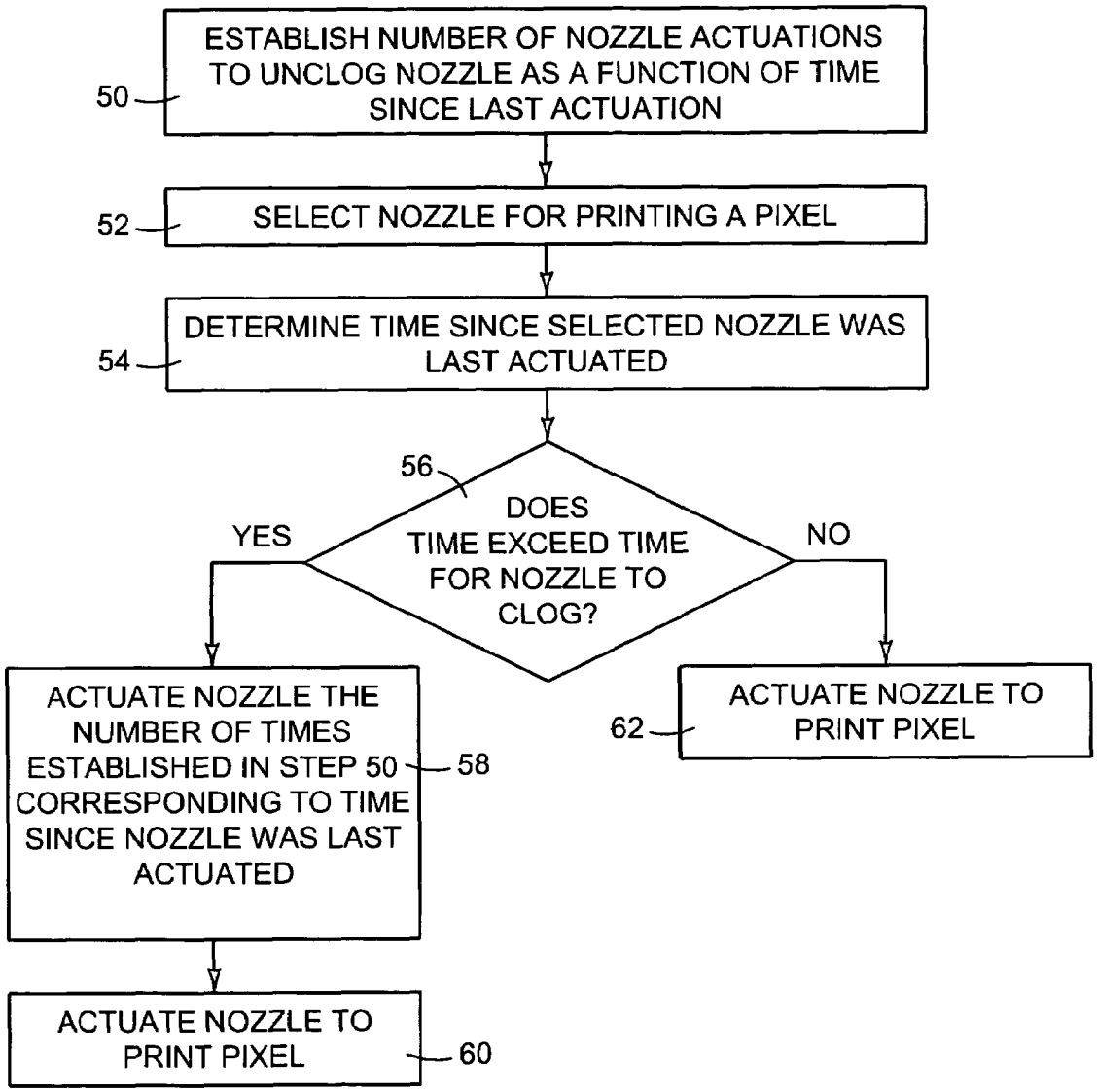
FIG. 7 is a flow chart illustrating a method for unclogging printer nozzles.

The flow chart of FIG. 7 illustrates a method for unclogging printer nozzles. Referring to FIG. 7, the number of actuations of a nozzle to unclog the nozzle as a function of time since the nozzle was last actuated is established (step 50), the nozzle is selected for printing a pixel (step 52) and the time since the nozzle was last actuated is determined (step 54). If the time since the nozzle was last actuated exceeds the time within which the nozzle becomes clogged (step 56), then, before the nozzle is actuated to print the pixel, the nozzle is actuated the number of times established in step 50 corresponding to the time since the nozzle was last actuated (step 58). Then, the nozzle is actuated to print the pixel (step 60). If the time since the nozzle was last actuated does not exceed the time within which the nozzle becomes clogged (step 56), then the nozzle is actuated to print the pixel without any prior actuations (step 62).

In one embodiment, the nozzle clearing actuations occur at the same frequency and with the same print medium transport speed for stationary printhead printers, or the same printhead scan speed for scanning printhead printers, as the pixel printing actuations. That is to say, the print resolution for the clearing actuations is the same as the print resolution for the pixel printing actuations. As used in this document, "print resolution" means the nominal center to center spacing of pixels, or pixel locations in the case of nozzle clearing actuations in which a pixel is not printed, measured in a direction across the width of an image. In inkjet printing, print resolution is often designated by the number of dots/pixels per inch (dpi). For example, a print resolution of 600 dpi represents a nominal center to center pixel spacing of 1/600 inch (42 microns) in which the center of each pixel or pixel location is approximately 1/600 inch from the center of an adjacent pixel or pixel location measured in a direction across the width of the image. Actuating nozzles at the same print resolution for both clog clearing and printing simplifies the printing process and allows the printer to operate at maximum production at all times by allowing maximum nozzle firing/actuating frequency along with maximum print media transport speed for stationary printhead printers or maximum scan speed for scanning printhead printers.

While it is expected that printer 10 (FIG. 1) will usually determine the time since each nozzle was last actuated, host device 28 (FIG. 1) could also perform this function, for example, when printer 10 does not have sufficient memory or processing capacity to determine actuation timing. Nozzle actuation times may be determined on a real-time basis by measuring the time since the last actuation of each nozzle or on a predictive basis by analyzing image print data in connection with pertinent printer settings such as print speed and page spacing (e.g., how fast the print medium is moving through the print zone and spacing between pages for stationary printhead printing, or how fast the printhead carriage is moving and time to index the page between swaths for scanning printhead printing).

Although the programming used to implement the methods described above will usually reside on printer controller 20 (FIG. 1), such programming could also reside on a host device 28 (FIG. 1) as part of a printer driver or image generating application program. This programming may be embodied in any processor readable medium. "Processor readable medium" as used in this document includes any medium that has the capacity to provide signals, instructions and/or data. A processor readable medium may take many forms, including, for example, non-volatile media, volatile media, and transmission media or signals. Common forms of processor-readable media include, but are not limited to, an application specific integrated circuit (ASIC), a compact disc (CD), a digital video disk (DVD), a random access memory (RAM), a read only memory (ROM), a programmable read only memory (PROM), an electronically erasable programmable read only memory (EEPROM), a disk, a carrier wave, a memory stick, a floppy disk, a flexible disk, a hard disk, a magnetic tape, a CD-ROM, an EPROM, and a FLASH-EPROM. Any signal that can propagate instructions or data may be considered a "processor-readable medium."

As noted at the beginning of this Description, the exemplary embodiments shown in the figures and described above illustrate but do not limit the invention. Other forms, details, and embodiments may be made and implemented. Therefore, the foregoing description should not be construed to limit the scope of the invention, which is defined in the following claims.

What is claimed is:

1. A method for printing a pixel with a printer having nozzles through which a marking material may be projected on to a print medium when the nozzle is actuated, the method comprising:

selecting a nozzle for printing a pixel at a first pixel location;

determining a time since the nozzle was last actuated; and if the time since the nozzle was last actuated exceeds a time within which the nozzle becomes clogged, then, before actuating the nozzle to print the pixel at the first pixel location, actuating the nozzle at pixel locations immediately preceding the first pixel location a number of actuations corresponding to the time since the nozzle was last actuated.

2. A processor readable medium having instructions for printing a pixel with a printer having nozzles through which a marking material may be projected on to a print medium when the nozzle is actuated, including instructions for:

selecting a nozzle for printing a pixel at a first pixel location;

determining a time since the nozzle was last actuated; and if the time since the nozzle was last actuated exceeds a time within which the nozzle becomes clogged, then, before actuating the nozzle to print the pixel at the first pixel location, actuating the nozzle at pixel locations immediately preceding the first pixel location a number of actuations corresponding to the time since the nozzle was last actuated.

* * * * *

UNITED STATES PATENT AND TRADEMARK OFFICE

CERTIFICATE OF CORRECTION

PATENT NO. : 7,360,859 B2
APPLICATION NO. : 11/041326
DATED : April 22, 2008
INVENTOR(S) : Robert F. Little et al.

It is certified that error appears in the above-identified patent and that said Letters Patent is hereby corrected as shown below:

On the title page, in field (56), under "Foreign Patent Documents", in column 2, line 3,
delete "WO 11192729 7/1999" and
Insert -- JP 11192729 7/1999 --, therefor.

Signed and Sealed this

Twelfth Day of August, 2008

JON W. DUDAS
*Director of the United States Patent and Trademark Office*